US005443584A

United States Patent [19]

Diefendahl et al.

[11] Patent Number: 5,443,584

[45] Date of Patent: Aug. 22, 1995

[54] DEPLOYMENT VEHICLE FOR A DEPLOYABLE BRIDGE

[75] Inventors: Wolfgang Diefendahl, Straelen; Hans-Norbert Wiedack, Mülheim, both of Germany

[73] Assignee: Krupp Fördertechnik GmbH, Duisburg, Germany

[21] Appl. No.: 191,915

[22] Filed: Feb. 4, 1994

[30] Foreign Application Priority Data

Feb. 4, 1993 [DE] Germany ..... 43 03 222.2

[51] Int. Cl.[6] ..... E01D 15/127

[52] U.S. Cl. ..... 14/2.4

[58] Field of Search ..... 14/2.4, 2.5, 78

[56] References Cited

U.S. PATENT DOCUMENTS

| | | | |
|---|---|---|---|
| 4,472,883 | 9/1984 | Ortega . | |
| 4,493,122 | 1/1985 | Echtler et al. | 14/2.4 |
| 5,067,191 | 11/1991 | Kinzel et al. | 14/2.4 |

FOREIGN PATENT DOCUMENTS

| | | | |
|---|---|---|---|
| 513406 | 11/1992 | European Pat. Off. . | |
| 1773603 | 7/1971 | Germany . | |
| 158273 | 1/1983 | Germany . | |
| 8337379 | 3/1984 | Germany . | |
| 3517724 | 3/1986 | Germany . | |
| 3606363 | 9/1987 | Germany . | |
| 3628273 | 3/1988 | Germany . | |
| 3100432 | 6/1989 | Germany . | |
| 3802083 | 7/1989 | Germany . | |
| 3807035 | 9/1989 | Germany . | |
| 3827617 | 2/1990 | Germany . | |
| 3912585 | 10/1990 | Germany . | |
| 5033312 | 2/1993 | Japan | 14/2.4 |

*Primary Examiner*—William P. Neuder

*Attorney, Agent, or Firm*—Spencer, Frank & Schneider

[57] ABSTRACT

A bridge deploying vehicle includes a deployment arm mounted on the vehicle for pivotal motion. The deployment arm has a length dimension and a frontal end oriented toward a bridge end while the bridge is being handled by the deployment arm. A first roller assembly formed of a plurality of rollers is pivotally mounted on the deployment arm for pivotal motion relative thereto about an axis perpendicular to the length dimension of the deployment arm; and a second roller assembly formed of a plurality of rollers is pivotally mounted on the deployment arm for pivotal motion relative thereto about an axis perpendicular to the length dimension of the deployment arm. The first roller assembly is closer to the frontal end of the deployment arm than the second roller assembly. During handling of the bridge by the deployment arm, the first and second roller assemblies enter an entrance pocket at the bridge end and are guided onto a runner rail mounted on the bridge. An angle measuring device is mounted on the deployment arm for measuring an angular position of the first roller assembly relative to the length dimension of the deployment arm. There is further provided a length measuring device mounted on the deployment arm for measuring a distance between the first roller assembly situated on the runner rail and the entrance pocket.

6 Claims, 3 Drawing Sheets

DEPLOYMENT VEHICLE FOR A DEPLOYABLE BRIDGE

CROSS REFERENCE TO RELATED APPLICATION

This application claims the priority of German Application No. P 43 03 222.2 filed Feb. 4, 1993, which is incorporated herein by reference.

BACKGROUND OF THE INVENTION

The invention relates to a deployment vehicle which has a deployment arm provided with a frontal and a rear roller assembly for deploying a deployable bridge which is provided at its underside with a runner rail configuration defining a track for guiding the roller assemblies. At the ends of the bridge the track has an upwardly open entrance pocket through which the roller assemblies are introduced and guided onto the track.

A deployment vehicle of the above-outlined type and a bridge deployable thereby are disclosed in German Offenlegungsschrift (application published without examination) 36 28 273. The entrance pockets arranged at the bridge ends by means of which the roller assemblies are threaded (guided) onto the track are disclosed in German Offenlegungsschrift 35 17 724.

The roller assemblies have, at each side of the bridge, several serially arranged rollers which are, relative to the deployment arm, pivotal as a unit about a horizontal axis situated at their common mid point. The pivotal axis extends parallel to the axes of the rollers and transversely to the longitudinal axis of the deployment arm.

Upon deployment of the bridge the frontal and rearward roller assemblies engage the runner rails of the bridge and maintain the bridge in the desired position relative to the horizontal. By changing the inclination, the bridge end situated remote from the deployment vehicle may be deposited at the remote (distal) end of the obstacle to be spanned. Upon further lowering of the deployment arm first the rearward roller assembly exits the runner rail of the bridge and thus the bridge which is supported now only by the frontal roller assembly may be, as a result of further lowering of the deployment arm, also deposited at the proximal end of the obstacle to be spanned. Such a bridge deploying (depositing) process is relatively simple and void of problems.

Upon removing the bridge from the obstacle and stowing it on the vehicle, first the frontal roller assembly has to be introduced through the entrance pocket into the runner rails of the bridge. For such a thread-in operation of the second or rearward roller assembly, the deployment arm has to be raised until the runner rails of the bridge and the deployment arm are in a linear alignment with one another. In this position the runner rails and the rollers of the rearward roller assembly have identical heights. Further, the deployment arm has to have such a relative distance from the bridge that the rollers—viewed in the longitudinal direction—are situated in the zone of the entrance pocket.

Provided that sufficient personnel is available, the correct relative position may be observed externally of the vehicle and communicated to the vehicle driver. If, however, a bridge removal and stowing operation has to be carried out exclusively by the driver of the deployment vehicle great difficulties are encountered and, even if such work can be performed at all, it is a very time-consuming process.

SUMMARY OF THE INVENTION

It is an object of the invention to provide an improved deployment vehicle of the above-outlined type in which the stowing of the deployed bridge may be securely carried out exclusively from the vehicle itself.

This object and others to become apparent as the specification progresses, are accomplished by the invention, according to which, briefly stated, the bridge deploying vehicle includes a deployment arm mounted on the vehicle for pivotal motion. The deployment arm has a length dimension and a frontal end oriented toward a bridge end while the bridge is being handled by the deployment arm. A first roller assembly formed of a plurality of rollers is pivotally mounted on the deployment arm for pivotal motion relative thereto about an axis perpendicular to the length dimension of the deployment arm; and a second roller assembly formed of a plurality of rollers is pivotally mounted on the deployment arm for pivotal motion relative thereto about an axis perpendicular to the length dimension of the deployment arm. The first roller assembly is closer to the frontal end of the deployment arm than the second roller assembly. During handling of the bridge by the deployment arm, the first and second roller assemblies enter an entrance pocket at the bridge end and are guided onto a runner rail mounted on the bridge. An angle measuring device is mounted on the deployment arm for measuring an angular position of the first roller assembly relative to the length dimension of the deployment arm. There is further provided a length measuring device mounted on the deployment arm for measuring a distance between the first roller assembly situated on the runner rail and the entrance pocket.

Under length measuring means there is to be understood any measuring system which is capable of determining, in length units, positions relative to a reference position.

The invention is based on the following problem-solving principle:

During the thread-in of the second (rearward) roller assembly, the runner rails of the bridge and the deployment arm assume a linear, aligned relationship. The imaginary straight line from the support point of the bridge on the distal side of the obstacle extends to the pivot point of the deployment arm on the deployment vehicle or on the displacement frame, as the case may be. In order to achieve such a condition automatically, the frontal roller assembly has to travel a very precise path length (depth of penetration) from the entrance pocket into the runner rail. In addition to the actual dimensions of the deployment arm and the bridge length, the depth of penetration depends from the angle between the imaginary middle plane of the runner rails and the deployment arm during the thread-in of the first, frontal roller assembly. Such angle is essentially affected by the orientation of the bridge which may have been deployed at an inclination to the horizontal.

By virtue of the angle measuring system carried by the deployment arm according to the invention, the above-defined angle may be determined and thereupon, for example by an onboard computer, the penetration depth of the first roller assembly may be determined. By virtue of the path or length measuring system provided according to the invention, the actual penetration depth of the second roller assembly may be controlled by comparing it with the determined value.

In a preferred embodiment of the invention the angle measuring system has an angular position signal transmitter which detects the rotary motion (angular displacement) of the forward roller assembly and which is connected with the deployment arm. Preferably, the length measuring system has a proximity sensor which is directed to uniformly spaced projections extending parallel to the runner rails. The projections may be formed by the pins or stubs which, as a rule, are present in any event on the bridge or by teeth of a toothed rack. In an alternative embodiment of the invention the length measuring system has a source which emits electromagnetic or acoustic waves and which is carried by the deployment vehicle, for example a laser source or an ultrasonic apparatus. The length measuring system further has a reflector mounted on the bridge. The penetration depth is determined and monitored based on the difference between one measurement during the thread-in and one measurement in the fully entered (penetrated) condition of the first roller assembly.

DESCRIPTION OF THE PREFERRED EMBODIMENT

Figure 1:
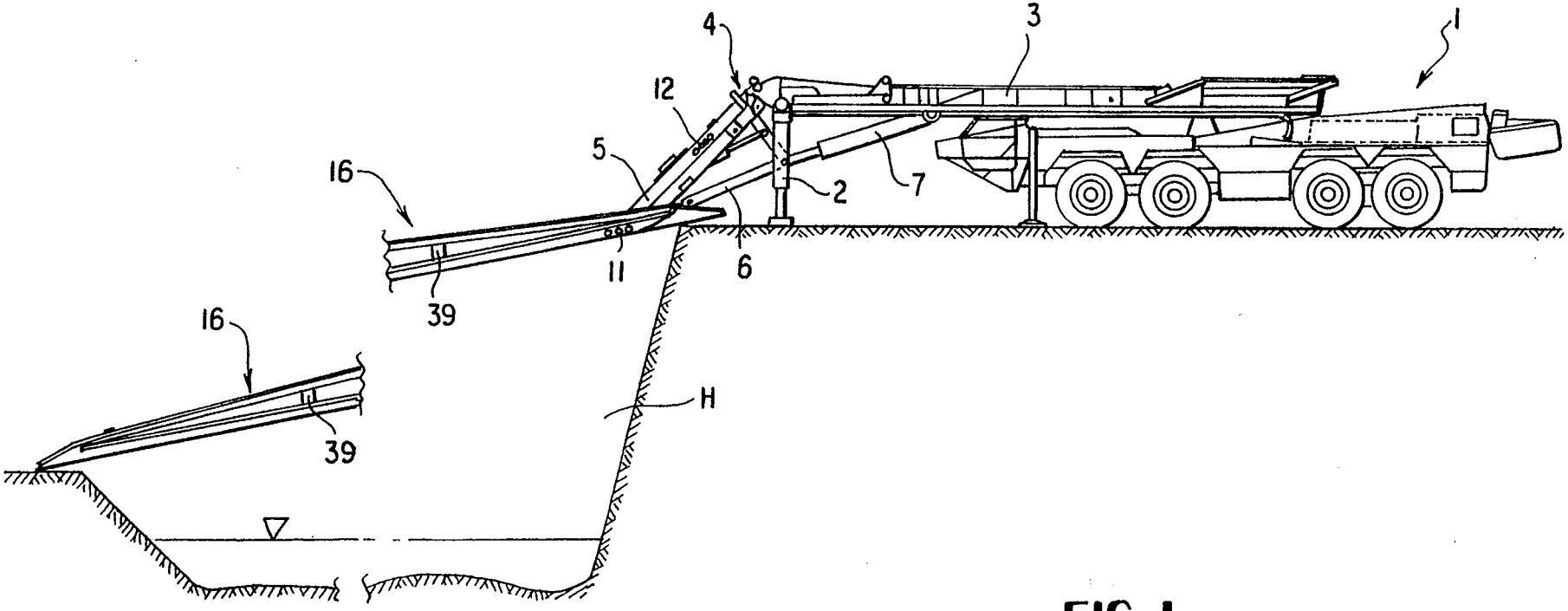
FIG. 1 is a schematic side elevational view of a deployment vehicle during stowing of a non-horizontally deployed bridge, the bridge being shown in a sectional view along its center plane.

Turning to FIG. 1, the deployment vehicle (also called launching or laying vehicle) generally designated at 1 has at one free end a displacement frame 3 supportable on the ground by hydraulic cylinders 2. A deployment arm 5 (also called launching or laying arm) is pivotally secured to the frame 3 at 4. The deployment arm 5 is provided with a foldable and unfoldable triangular stiffening and support structure having a lower pressure or compression truss 6 to which a force is exerted by a hydraulic cylinder 7 pivotally mounted on the shifting or displacement frame 3. With the aid of the hydraulic cylinder 7 the deployment arm 5 may be arbitrarily varied in its inclination within structural limits.

The deployment arm 5 has two roller assemblies 11 and 12 arranged at a distance from one another as viewed along the length of the deployment arm 5. Also referring to FIGS. 2–4, each roller assembly 11, 12 has on each side of the deployment arm 5, four rollers 13 which are supported in a rocker (which may be of multipart construction) 14 which, in turn, is pivotally supported in the housing of the deployment arm 5 by means of bearing pins 15.

The bridge 16 to be deployed across an obstacle H may be composed in a known manner of one or more bridge sections. In the zone of the lower bridge boom 17 at both sides of the bridge, linear, throughgoing runner rails 18 are provided for receiving the rollers 13. The angle $\alpha$ (FIG. 2) of the entire roller assembly 11 or 12 with respect to the deployment arm 5 is set automatically by the orientation of the runner rails 18 at the time when the rollers 13 are positioned therein. For introducing the roller assemblies 11 and 12 into the runner rail 18, at the ends of the bridge 16 entrance pockets 19 are arranged where the otherwise channel or trough-shaped runner rail 18 is upwardly open.

Figure 3:
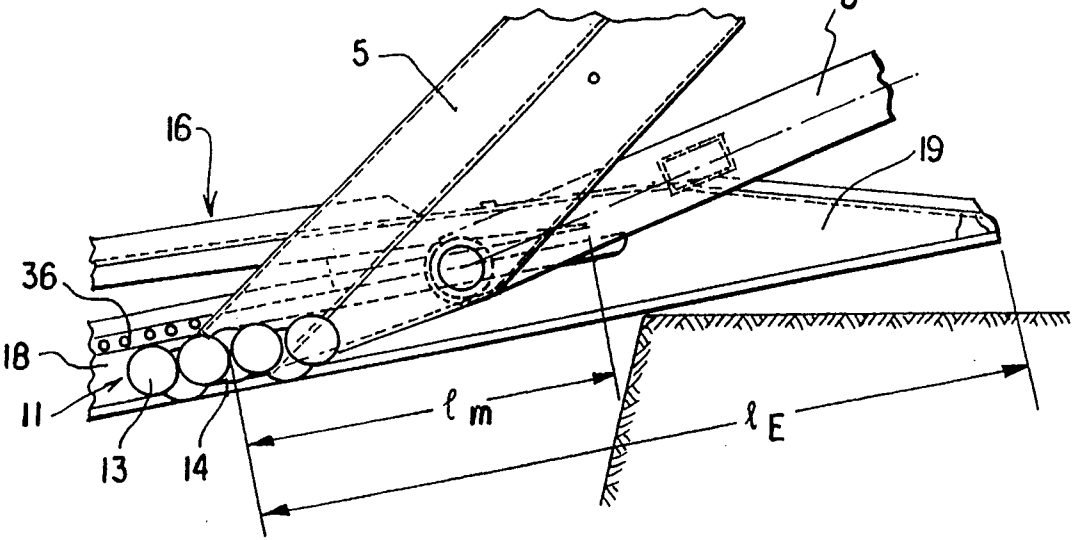
FIG. 3 is a view similar to FIG. 2 showing the first roller assembly in a penetrated position.
Figure 4:
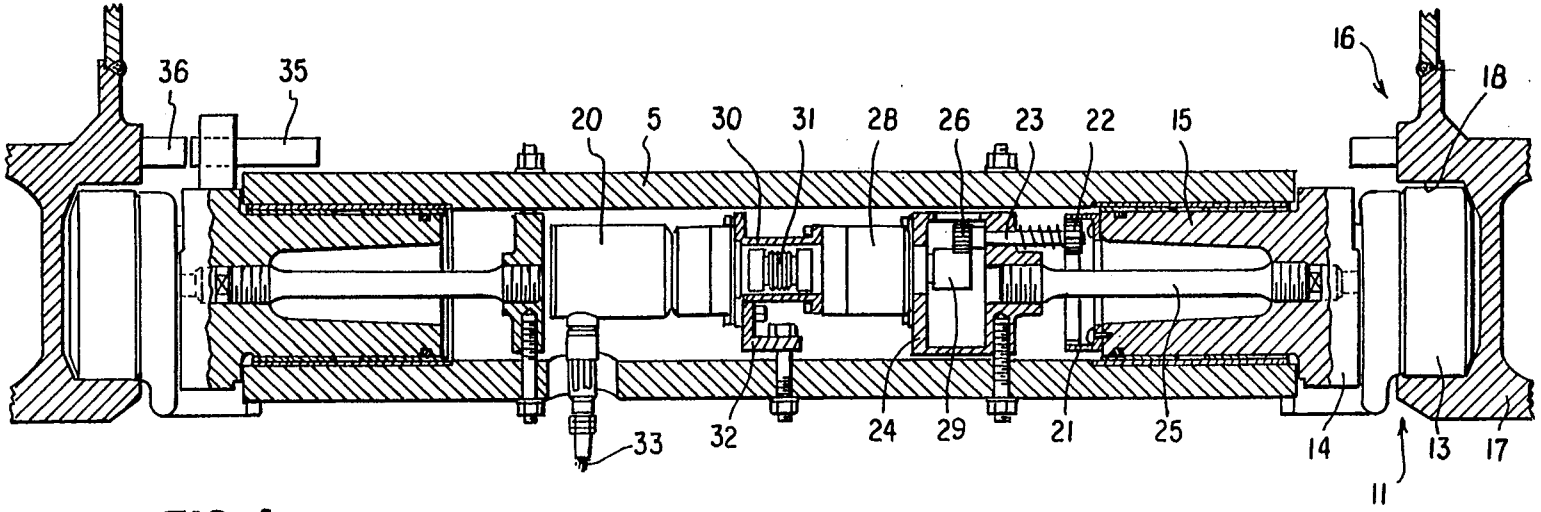
FIG. 4 is a longitudinal sectional view of a deployment arm including an angle measuring system and a length measuring system, taken along a plane passing through the middle of the frontal roller assembly.

With particular reference to FIG. 4, an angle measuring system is mounted in the deployment arm 5, in the zone of the frontal roller assembly 11. The system has a rotary displacement value transmitter 20 which is connected with the pin of the rocker 14 of the frontal roller assembly 11 as follows: at the pin 15 of the rocker 14 an internally toothed gear or gear ring 21 is affixed. With the inner ring gear 21 a pinion 22 meshes which, with its shaft 23, is supported in an axially resilient manner in a bearing of a support 24 which simultaneously serves, by means of a threaded rod 25, as an axial securement of that part of the roller assembly 11 which is shown at the right-hand side in FIG. 3.

At the other end of the shaft 23 a pinion 26 is mounted which meshes with a spur gear 29 affixed to the input shaft of a measuring gearing unit 28. The measuring gearing unit 28 is secured to the support 24. The angle transmitter 20 is supported by means of a tubular intermediate or adaptor member 30 provided with flanges, and its input shaft is torque-transmittingly connected by means of a coupling 31 with the output shaft of the measuring gearing unit 28. The intermediate member 31 is supported by an angle member 32 on the deployment arm 5.

The pivotal motion of the rocker 14 of the roller assembly 11 is thus transferred to the angle transmitter 20 by means of the pin 15, the ring gear 21 and the pinion 22 as well as the gear pair 26, 29 and the measuring gearing unit 28. The angle transmitter 20 transmits a signal—representing the pivotal angle—via a coupling cable 33 to the control panel of the deployment vehicle. In the described embodiment the pivotal angle of only one side is measured and such a pivotal angle is evaluated as a measure for the angle $\alpha$ between the deployment arm 5 and the central plane 18' of the runner rail 18.

Figure 2:
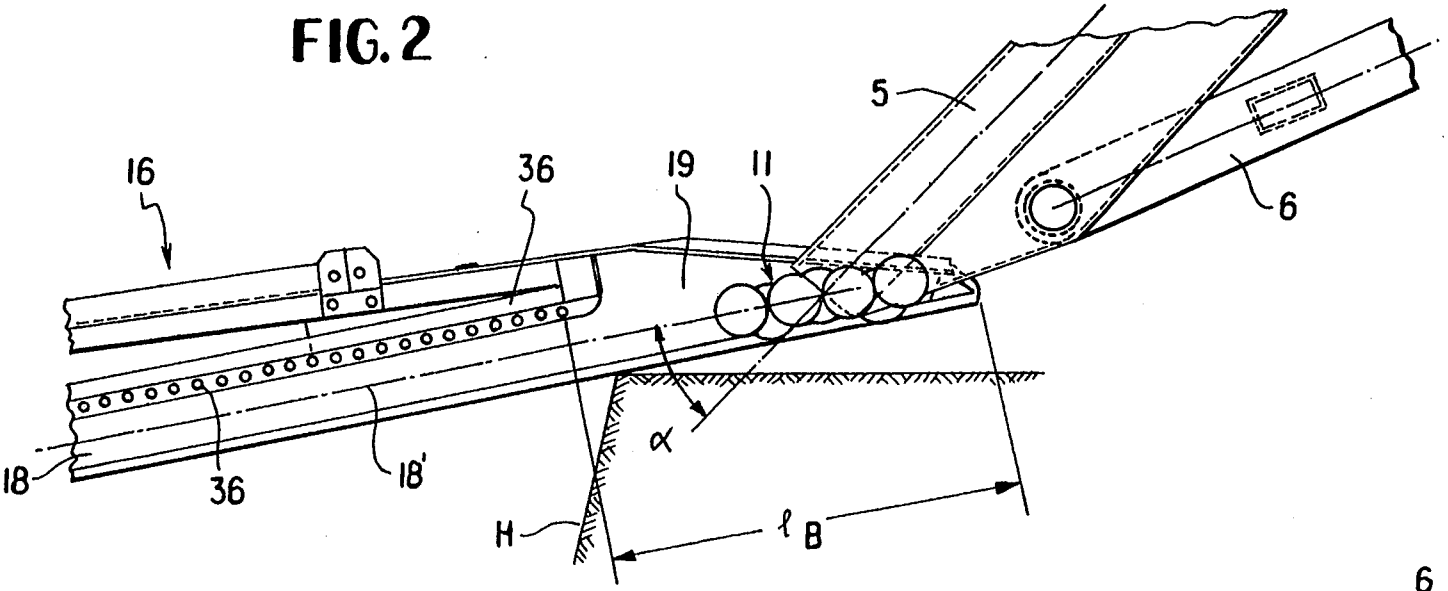
FIG. 2 is a schematic side elevational view of an end of the bridge and the deployment arm of the deployment vehicle, during introduction of the first roller assembly onto the guiding rail of the bridge.

While the pivotal angle may be measured at any time, a measurement of importance is performed when the frontal roller assembly 11 is in the entrance pocket 19 on the lower running face of the runner rail 18, as shown in FIG. 2. The results of this measurement form the basis for the computation of the required penetration depth $l_E$ shown in FIG. 3. The penetration depth $l_E$ related to the bridge tip has the following significance: if the frontal roller assembly 11 penetrates to the depth $l_E$ and the deployment arm 5 is, given a stationary position of the deployment vehicle 1, lifted to such an extent until the central plane 18' of the runner rail 18 and the deployment arm 5 are in alignment, then the second roller assembly 12 just arrives into the entrance pocket 19 making it possible that the second roller assembly 12 too, may be easily threaded into the runner rail 18.

To be able to compare the desired or set-point value of the penetration depth $l_E$ determined by the angle measurement with the actual penetration depth, the deployment arm 5 is additionally provided with a path or length measuring system. In the described embodiment such a system includes a proximity sensor 35 situated preferably on the rocker 14, in the zone of the pivotal axis of the roller assembly 11 (bearing for the pivotal pins 15). The proximity sensor is oriented towards the tooth rack pins 36 which are present in any event above the runner rail 18 for advancing the bridge. The distance of the center of the roller assembly 11 from the bridge tip may be determined by the number of the pins 36 moving past the proximity sensor 35. In this measurement the penetration depth $l_E$ related to the bridge tip is obtained by the formula $$l_E = l_m + l_B$$

wherein $l_m$ is the length measured directly along the series of pins 36 (FIG. 3) and $l_B$ is the distance of the first pin 36 from the bridge tip (FIG. 2).

Figure 5:
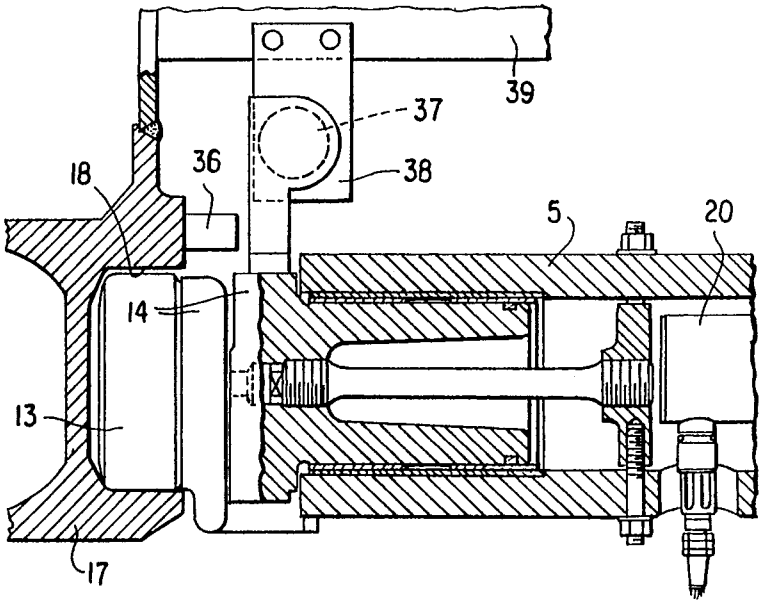
FIG. 5 is a fragmentary longitudinal sectional view of a deployment arm including another embodiment of a length measuring system, taken along a plane passing through the middle of the frontal roller assembly.

Reverting to FIG. 1 and also referring to FIG. 5, as a departure from the earlier described embodiment, the length measuring system may also include a combined laser source and receiver or an adequate ultrasonic device 37 mounted on the rocker 14 of the deployment arm 5 and directed to a reflector 38 mounted on a transverse support or beam 39 of the bridge 16. The penetration depth is obtained as a difference between two measurements during introduction of the first roller assembly into the entrance pocket and in the penetrated condition.

It will be understood that the above description of the present invention is susceptible to various modifications, changes and adaptations, and the same are intended to be comprehended within the meaning and range of equivalents of the appended claims.

What is claimed is:

1. A combination of a bridge deploying vehicle with a deployable bridge; said bridge having a length dimension and an end, comprising (a) a runner rail mounted on said bridge and extending parallel to the length dimension of said bridge substantially to said end thereof;

(b) an open entrance pocket situated in a zone of the bridge end and leading to said runner rail;

(c) a deployment arm mounted on the vehicle for pivotal motion; said deployment arm having a length dimension and a frontal end oriented toward said bridge end while the bridge is being handled by the deployment arm;

(d) a first roller assembly formed of a plurality of rollers;

(e) first pivot means for mounting said first roller assembly on said deployment arm for pivotal motion relative to said deployment arm about an axis perpendicular to said length dimension of said deployment arm;

(f) a second roller assembly formed of a plurality of rollers;

(g) second pivot means for mounting said second roller assembly on said deployment arm for pivotal motion relative to said deployment arm about an axis perpendicular to said length dimension of said deployment arm; said first roller assembly being spaced from said second roller assembly along said length dimension; said first roller assembly being closer to said frontal end of said deployment arm than said second roller assembly; during handling of the bridge by said deployment arm said first and second roller assemblies enter said entrance pocket and are guided onto said runner rail;

(h) an angle measuring means mounted on said deployment arm for measuring an angular position of said first roller assembly relative to said length dimension of said deployment arm; and (i) a length measuring means mounted on said deployment arm for measuring a distance between said first roller assembly situated on said runner rail and said entrance pocket.

2. The combination as defined in claim 1, wherein said angle measuring means includes a rotary displacement value transmitter for detecting pivotal motions of said first roller assembly.

3. The combination as defined in claim 1, wherein said bridge includes a plurality of uniformly spaced components arranged in a series oriented parallel to said runner rail; further wherein said length measuring means includes a proximity switch oriented towards said components and being arranged on said deployment arm for sequentially passing by said components upon a displacement of said deployment arm relative to said runner rail in a direction parallel to said length dimension of said bridge.

4. The combination as defined in claim 1, wherein said length measuring means includes a source mounted on said deployment arm for generating waves travelling in air and a reflector mounted on said bridge for reflecting said waves.

5. The combination as defined in claim 1, wherein said length measuring means includes a source mounted on said deployment arm for generating electromagnetic waves and a reflector mounted on said bridge for reflecting said waves.

6. The combination as defined in claim 1, wherein said length measuring means includes a source mounted on said deployment arm for generating acoustic waves and a reflector mounted on said bridge for reflecting said waves.

* * * * *

UNITED STATES PATENT AND TRADEMARK OFFICE

CERTIFICATE OF CORRECTION

PATENT NO. : 5,443,584

DATED : August 22, 1995

INVENTOR(S) : Wolfgang Diefendahl et al

It is certified that error appears in the above-indentified patent and that said Letters Patent is hereby corrected as shown below:

On the title page, item [75] the second inventor's last name should read -Wiedeck--.

Signed and Sealed this

Seventeenth Day of October, 1995

Bruce Lehman

*Attest:*

BRUCE LEHMAN

*Attesting Officer*

*Commissioner of Patents and Trademarks*